United States Patent [19]

Ishikawa et al.

[11] Patent Number: 4,465,457

[45] Date of Patent: Aug. 14, 1984

[54] LIQUID FUEL BURNING DEVICE

[75] Inventors: Katsuhiko Ishikawa, Nara; Yoshitaka Kawasaki, Kadoma; Motoo Yotsuya, Nara, all of Japan

[73] Assignee: Matsushita Electric Industrial Co., Ltd., Osaka, Japan

[21] Appl. No.: 308,139

[22] Filed: Oct. 2, 1981

[30] Foreign Application Priority Data

| | | | |
|---|---|---|---|
| Oct. 9, 1980 | [JP] | Japan | 55-141214 |
| Nov. 10, 1980 | [JP] | Japan | 55-158619 |
| Mar. 20, 1981 | [JP] | Japan | 56-40923 |

[51] Int. Cl.[3] ..... F23D 5/00

[52] U.S. Cl. ..... 431/201; 431/309; 431/312; 126/96

[58] Field of Search ..... 431/201, 102, 299, 310, 431/312, 314, 313, 302, 309, 298, 200; 126/45, 96; 239/145

[56] References Cited

U.S. PATENT DOCUMENTS

| | | | |
|---|---|---|---|
| 242,938 | 6/1881 | Knipe | 431/302 X |
| 614,080 | 11/1898 | Blount | 431/201 |
| 939,121 | 11/1909 | Braaten | 431/309 X |
| 1,420,003 | 6/1922 | Wegman | 431/201 |
| 2,075,242 | 3/1937 | Todaro | 431/309 X |
| 2,197,091 | 4/1940 | Bloch et al. | 431/201 X |
| 2,546,731 | 3/1951 | Duff | 431/201 |
| 2,671,439 | 3/1954 | Foster et al. | 431/201 X |
| 2,832,404 | 4/1958 | Thorpe | 431/201 X |
| 3,119,438 | 1/1964 | Richardson | 431/201 |

FOREIGN PATENT DOCUMENTS

| | | | |
|---|---|---|---|
| 145696 | 3/1952 | Australia | 431/201 |
| 763371 | 12/1956 | United Kingdom | 431/201 |

*Primary Examiner*—Randall L. Green

*Attorney, Agent, or Firm*—Stevens, Davis, Miller & Mosher

[57] ABSTRACT

A liquid fuel burning device suitable for kerosene stove, kerosene kitchen range or the like. The device has an inner and outer flame sleeves each having a multiplicity of pores and a wick interposed between these sleeves. The wick has a fuel evaporating portion projectable into the annular burning space formed between these sleeves. At least one of these sleeves is provided with at least one vertical row of air pores in its portion facing the fuel evaporating portion of the wick. Above the region of vertical row of air pores, formed is a horizontal row of air pores having a multiplicity of pores arranged at a higher density than the pores in the other portion of the wall. In the case where the vertical and horizontal rows of air pores are formed in the inner flame sleeve, a partition plate having apertures is attached to the inner side of the inner flame sleeve at a level above the horizontal row or air pores. The ratio of the total area of apertures in the partition plate is selected to be smaller than 20% of the horizontal cross-sectional area of the inner flame sleeve as measured at the inner side of the latter.

6 Claims, 13 Drawing Figures

LIQUID FUEL BURNING DEVICE

BACKGROUND OF THE INVENTION

The present invention relates to a liquid fuel burning device of wick evaporation type and, more particularly, to a liquid fuel burning device which is improved to prevent any reduction of fuel evaporation rate due to deposition of tar content to the fuel evaporation section of the wick and to smooth the transition from the ignition to a steady burning, while ensuring stable burning for a long period of time.

Hitherto, there have been proposed and used various types of so-called wick evaporation type liquid fuel burning device in which a liquid fuel sucked by the capillary action of a wick is evaporated and burnt at the end of the wick. Typical examples of such liquid fuel burning device is kerosene stoves, kerosene kitchen range and so forth.

These conventional liquid fuel burning devices, however, suffer various drawbacks. Namely, in the liquid fuel burning devices of wick evaporation type, it is extremely difficult to maintain a stable burning of liquid fuel. In addition, since the end of the wick where the liquid fuel is evaporated is subjected to a high temperature and sufficient oxygen during the burning, a part of the liquid fuel is easily changed into tar through oxidation, polymerization and condensation. The tar inconveniently deposits on the fuel evaporating portion of the wick to cause various troubles as stated below.

(1) The deposition of tar covers the surface of the fuel evaporating portion and clogs the internal capillary tubes to restrain the sucking action of fuel, as well as evaporation, resulting in a lowered rate of burning.

(2) The lowered rate of burning causes an unbalance between the air and fuel in the burning area to cause an imperfect burning to generate a large amount of carbon monoxide which is harmful to human bodies, while releasing offensive odor and much carbon.

(3) The deposition of tar increases the volume, i.e. the thickness, of the fuel evaporating portion of the wick. This dangerously interferes with the ability of the wick to be lowered for flame extinction.

(4) The tar inconveniently flows into the gap between the wick and the peripheral metallic sleeve supporting the wick, so as to allow the wick to stick to the sleeve to cause the same danger as mentioned in the above item (3).

(5) The accumulation of tar at the end of the fuel evaporating portion makes starting of the burning device difficult, and retards the propagation of flame after initiating a fire on the wick. Before the flame is propagated over the entire periphery of the wick, a large amount of carbon monoxide and carbon, as well as offensive odor, is released.

(6) The rate of supply of the air to the burner sleeve is determined by the draft, i.e. the wind generating force, of the burner sleeve, and is largely affected also by the ambient temperature and the presence of stream of a air or wind. The state of flame on the pores in the inner and outer flame sleeves in the burner sleeve is varied in accordance with the ratio between air and fuel, as well as the ambient temperature. Thus, the flames on the pores are easily formed and extinguished by an impact applied to the burner sleeve, presence of wind and so forth. In consequence, the evaporation latent heat supplied to the liquid fuel contained by the wick is easily changed. Thus, the burning is unstabilized by various external disturbance factors such as changes in the ambient temperature, wind, impact and the like.

The deposition of tar which causes the troubles mentioned in above items (1) to (5) is serious particularly when a part of the fuel has been degraded due to, for example, generation of oxides or peroxides as a result of application of heat or leaving the fuel for a long time in sun light, or when a different fraction of higher boiling point is mixed in the fuel as in the case of mixing of light oil, heavy oil, machine oil, salad oil or the like in the kerosene. In these cases, the deposition of tar takes place in a short period of time.

SUMMARY OF THE INVENTION

Accordingly, an object of the invention is to provide a liquid fuel burning device which can ensure stable starting and burning characteristics for a long period of time against external disturbance factors, thereby to obviate the above described problems of the prior art.

To this end, according to the invention, there is provided a liquid fuel burning device comprising an inner flame sleeve having a multiplicity of pores in the wall thereof, an outer flame sleeve surrounding the inner flame sleeve with a suitable annular gap therebetween and having a multiplicity of pores in the wall thereof, and a wick having a fuel evaporating portion projected into the annular gap, wherein at least a vertical row of air pores is formed in the wall surface of at least one of the inner and outer flame sleeves facing the fuel evaporating portion of the wick.

The above and other objects, as well as advantageous features of the invention will become clear from the following description of the preferred embodiment taken in conjunction with the accompanying drawings.

DESCRIPTION OF THE PREFERRED EMBODIMENTS

Figure 1:
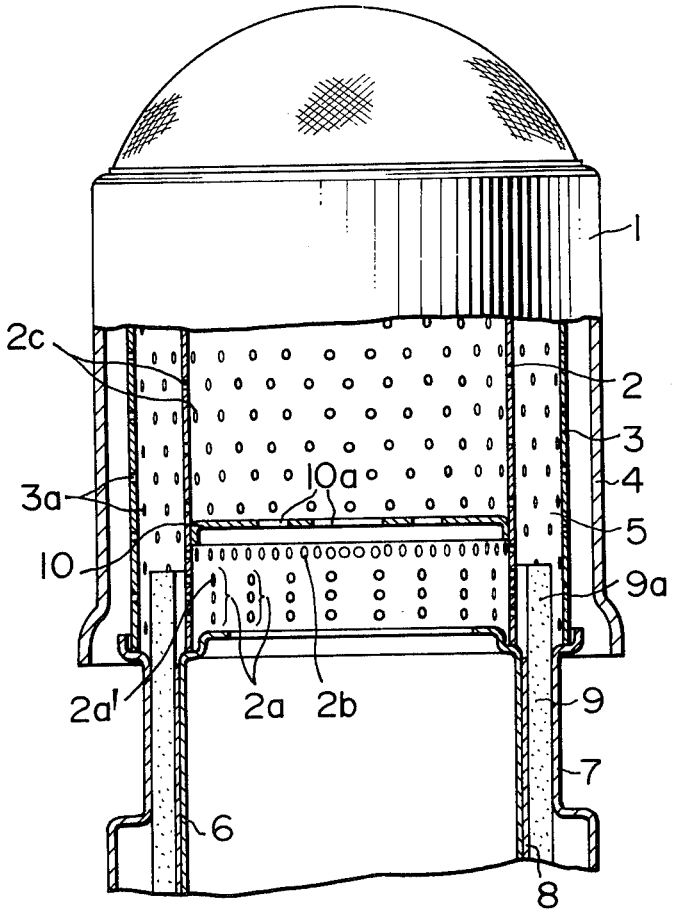
FIG. 1 is a partly sectioned front elevational view of a liquid fuel burning device constructed in accordance with an embodiment of the invention.

Referring to FIG. 1, a burner sleeve assembly 1 includes an inner flame sleeve 2, outer flame sleeve 3 and an outer cylinder 4 arranged coaxially with one another. A burning space 5 is formed between the inner flame sleeve 2 and the outer flame sleeve 3. A wick 9 fixed to a wick holder 8 is disposed between a wick inner sleeve 6 and a wick outer sleeve 7. The end of the wick 9 constituting a fuel evaporating portion 9*a* is projected into the burning space 5. The wick 9 is adapted to be extended upwardly and retracted downwardly together with the wick holder 8 by means of a suitable wick driving means (not shown).

In the surface of the wall of the inner flame sleeve 2 facing the fuel evaporating portion 9*a*, there are formed a plurality of vertical rows 2*a* each having a plurality of air pores 2*a'*. Also, air pores 2*b* are densely formed along a horizontal circumferential row in the same surface of the inner flame sleeve 2 at a portion of the latter above the vertical rows 2a of air pores. Furthermore, in the same surface of the inner flame sleeve 2, there is formed a plurality of horizontal rows of air pores 2c such that the pores 2c are arranged in a staggered manner. On the other hand, the outer flame sleeve 3 is provided with a plurality of horizontal rows of air pores 3a arranged also in a staggered manner.

A disc-shaped partition plate 10 is attached to the inner side of the inner flame sleeve 2. The partition plate 10 is provided with a plurality of apertures 10a formed therein. The total area of these apertures 10a is selected to be less than 20% of the entire area of the partition plate 10, i.e. the horizontal cross-sectional area of the inner flame sleeve 2 as measured at the inside of the latter.

Figure 2:
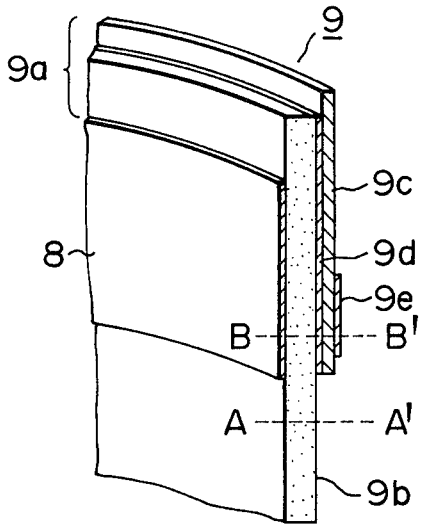
FIG. 2 is a perspective view of an essential portion of the liquid fuel burning device shown in FIG. 1.

As will be understood from FIG. 2, the wick generally designated by a reference numeral 9 includes a main wick 9b and an auxiliary wick 9c for propagation of flame attached to the outer periphery of the upper fuel evaporating portion 9a, through the medium of a fuel impermeable member 9d such as an aluminum foil. The lower end of the auxiliary wick 9c is spaced from the level (broken line A-A') of the fuel during the normal burning of the fuel, but is immersed in the liquid fuel as the wick 9 as a whole is lowered for flame extinction. The liquid fuel level when the wick 9 is lowered is shown by a broken line B-B'.

Reference numeral 8 designates a tape for fixing the wick.

The number and diameter of the air pores 3a formed in the wall surface facing the auxiliary wick 9c, i.e. the pores formed in the predetermined area of the outer flame sleeve 3, are selected to be smaller than the number and diameter of the pores formed in the other portion, e.g. the pores 2a formed in a predetermined area of the inner flame sleeve 2 directly facing the fuel evaporating portion 9a of the main wick 9b.

Figure 3A:
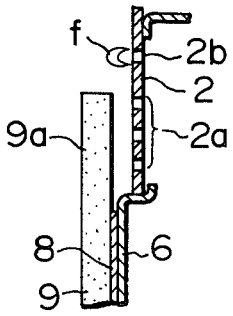
FIGS. 3A, 3B, 5, 6A, 6B, 9A and 9B are illustrations of operation of the liquid fuel burning device shown in FIG. 1.

At the beginning burning periods of the burning, as will be seen from FIG. 3A, flame "f" is stably formed on the air pores 2b which are densely arranged along the horizontal line. The heat generated by the flame is delivered to the fuel evaporating portion 9a as the evaporation latent heat to promote the evaporation of the fuel in that portion 9a. Air for promoting the evaporation is supplied through the vertical rows 2a of air pores. In this region, however, no flame is formed partly because of a too high fuel concentration and partly because of the low temperature.

Figure 3B:
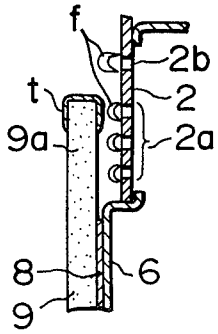

As the deposition of tar "t" on the fuel evaporating portion 9a becomes appreciable as a result of long use, the temperature of the fuel evaporating portion 9a and its vicinity is raised and the concentration of gaseous fuel becomes low in the area around the rows 2a of air pores, so that the pore flame "f" is formed in this region, as illustrated in FIG. 3B.

Since the pores in the pore rows 2a are arranged in vertical rows, the air released from the lower pores merges in the air released from the uppermost pores, so that an inflammable mixture is easily formed around the uppermost pores even by a slight reduction of fuel evaporation rate. The pore flame "f," therefore, begins with the region around the uppermost pores of the vertical rows 2a. Since this pore flame "f" takes a position opposing to the fuel evaporating portion 9a, the most part of the heat produced by the pore flame "f" is delivered to the fuel evaporating portion 9a to recover the fuel evaporation rate while thermally decomposing and removing the tar "t," thereby to prevent the reduction of evaporation of the liquid fuel.

In the event that the pore flame "f" on the pores of the uppermost stage is still insufficient, the pore flame "f" is naturally spread to the pores 2a' of the second stage to assist and promote the increase of the fuel evaporation rate and the removal of the tar "t," thanks to the arrangement of pores in vertical rows 2a. Thus, the pore flame "f" is formed in accordance with the extent of deposition of the tar "t" on the fuel evaporating portion 9a, to compensate for the reduction of fuel evaporation rate attributable to the tar deposition, and to decompose and remove the tar "t," thereby to ensure a stable burning for a long period of time while avoiding the release of carbon monoxide, offensive smell and carbon.

Figure 4:
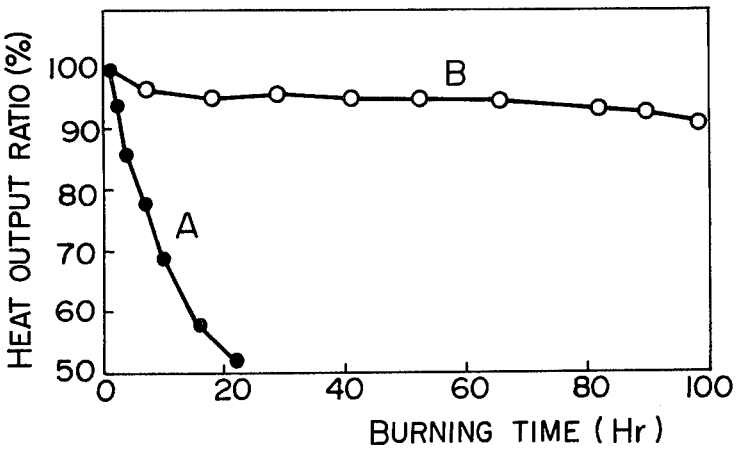
FIGS. 4, 7, 8A and 8B are graphs which show the characteristics of the liquid fuel burning device shown in FIG. 1.

In order to confirm the effect on the invention, a test was conducted using a kerosene stove with kerosene to which was added 0.1 vol% of salad oil, to obtain a result as shown in FIG. 4. The full-line curve A shows the burning characteristics of the conventional stove in relation to time. It will be seen that the heat output (Kcal/h) of the stove comes down to a level of 70% of the rating heat output and rate of generation of carbon monoxide and offensive odor was observed after a 10-hour operation. In contrast, as will be seen from the full-line curve B, the stove of the invention could maintain a heat output well exceeding 90% of the rating heat output even after 100-hour operation. In addition, no substantial generation of carbon monoxide and offensive odor was observed.

In the liquid fuel burning device of the described embodiment, it is possible to maintain a stable and superior burning characteristics, without suffering any deterioration of the starting and flame propagation characteristics, thanks to the decomposition and removal of the tar "t."

In addition, the undesirable increase of the thickness of the fuel evaporating portion 9a, as well as the sticking of the wick to the metallic portion such as the inner and outer wick sleeves 6, 7, is effectively avoided to ensure a smooth extension and retraction of the wick.

These advantages will be further enhanced by making the fuel evaporating portion 9a of a material which makes a catalytic action for thermally decomposing the hydrocarbon, e.g. silica-alumina, or making metal oxides such as alkali metal compounds $Cr_2O_3$ or the like present on the surface of the fuel evaporating portion 9a.

The arrangement of the air pore rows 2a and air pores 2b of the described embodiment is not exclusive. Namely, the rows 2a of air pores and the air pores 2b may be formed either in the inner flame sleeve 2 or outer flame sleeve 3 or in both of these sleeves.

Figure 5:
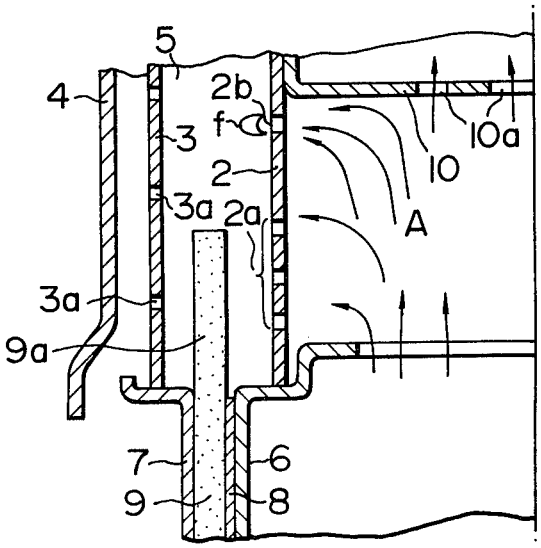

A part of the air flowing upward through the burner sleeve 1 due to the natural draft is made to pass through the inner flame sleeve 2. This part of the air is partly interrupted by the partition plate 10 to produce lateral dynamic and static pressures which act to direct the air toward the rows 2a of air pores and air pores 2b. More specifically, although the most part of air flowing upwardly through the wick inner sleeve 7 as indicated by an arrow A (see FIG. 5) is allowed to flow upward through the apertures 10a of the partition plate 10, the other part of the air is directed toward the burning space 5 through the rows 2a of air pores and the air pores 2b beneath the partition plate 10. Particularly, a large part of the air stream A is directed toward the air pores 2b just under the partition plate 10, due to the resistance imposed by the latter. In consequence, a mixture rich in air and, hence, capable of easily forming the pore flame "f" is formed in the region around the pores 2b. Therefore, a stable pore flame "f" is formed in this region as illustrated in FIG. 5. This pore flame "f" delivers the heat to the fuel evaporating portion 9a of the wick 9 at a constant rate without being affected by external disturbance such as wind and impact, so that the rate of evaporation of the fuel is very much stabilized.

In addition, the dense arrangement of the air pores 2b just under the partition plate 10 affords a sufficient temperature rise of the inner flame sleeve, due to the interaction between the flames on adjacent pores, which in turn further stabilizes the pore flame "f" to avoid the bad influence of the external disturbance factors.

Figure 7:
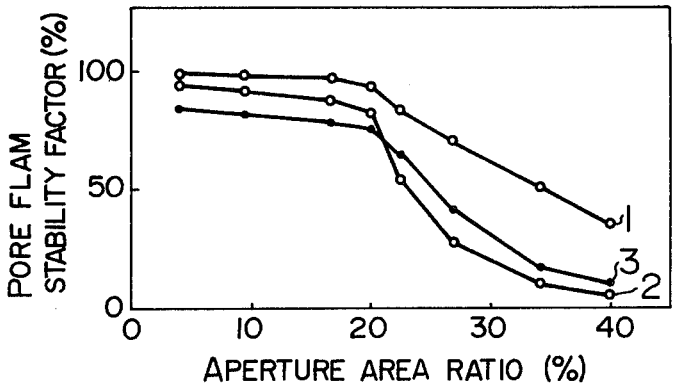

In order to evaluate the stability of the flame, a test was conducted with three types of burner sleeve 1 to investigate the relationship between the aperture area ratio of the partition plate 10 which will be mentioned later and flame stability factor which also will be mentioned later. Namely, the aperture area ratio in this specification is defined as the ratio of the total area of apertures formed in the partition plate and the whole area of the partition plate 10 which is given as $\pi R^2$ (R represents the radius of plate 10). Also, the flame stability factor is the ratio between the number of pore flames "f" which remain on the pores just under the partition plate 10 after blowing of wind at a velocity of 2 to 3 m/sec from the front side of the burner sleeve 1 and the number of the pore flames "f" formed on the pores before the blowing of wind. The three types of burner sleeves 1 used in this test had diameters of pores 2a of vertical rows ranging between 1.5 and 1 mm, 1.3 and 2 mm and between 1.2 and 3 mm, respectively. The result of this test is shown in FIG. 7. From FIG. 7, it will be seen that in each case a high stability of the pore flame "f" is obtained when the apertures area ratio falls below about 20%.

Figure 6A:
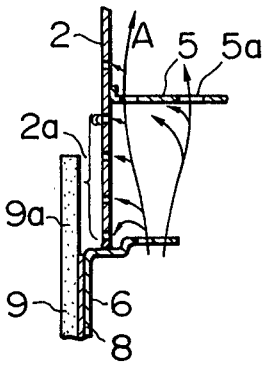
Figure 6B:
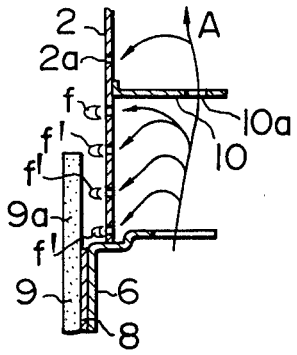

Furthermore, by concentrating the apertures 10a to the central region of the partition plate 10, it is possible to form a returning flow layer of air as illustrated in FIG. 6B to prevent the drop of temperature of the wall of inner flame sleeve 2, in contrast to the conventional arrangement in which the air is allowed to flow upwardly along the inner peripheral surface of the inner flame sleeve 2 as illustrated in FIG. 6A. Therefore, in the device of the invention, the pore flame is further stabilized, and, even when the fuel evaporation is lowered due to the tar deposition, the pore flame can easily be propagated to the pores in the lower stages, because the temperature around these pores in the lower stage is sufficiently high thanks to the heating effect provided by the returning flow layer of air. This effect will be explained in more detail hereinunder. When the fuel evaporation rate at the fuel evaporating portion 9a is decreased, the region of inflammable mixture of suitable air-fuel ratio is spread to the lower portion of the burning space 5, as stated before. In the conventional arrangement, however, the pore flame could hardly be spread to the pores of lower stages, because the temperature of the inner flame sleeve 2 was low. Accordingly to the invention, this problem is overcome because the temperature of the inner flame sleeve 2 is maintained sufficiently high. Therefore, "new" pore flames as indicated by "f'" are conveniently formed as the fuel evaporation rate is lowered, so that the rate of delivery of heat to the fuel evaporating portion is increased to recover the required fuel evaporation rate, while thermally decomposing and removing the tar "t" depositing on the fuel evaporating portion 9a of the wick 9.

Since the partition plate 10 acts as a heat radiating member for emitting the heat from the inner flame sleeve 2, it is preferably made of a material having a low heat conductivity such as stainless steel, or other metals coated with a ceramic, in order to preserve the heat. By so doing, it is possible to further enhance the above-described advantageous effect.

As has been described, by selecting the total area of apertures 10a at a level below 20% of the whole area of the partition plate 10, i.e. the horizontal cross-sectional area of the inner flame sleeve 2 as measured at the inside of the latter, it is possible to stabilize the pore flames on the pores disposed at the lower portion of the inner air pores. In addition, the release of heat from the inner flame sleeve 2 is effectively suppressed by the partition plate 10 made of a material having low heat conductivity. In consequence, the state of burning of the liquid fuel is remarkably stabilized and various problems attributable to the deposition of tar is eliminated advantageously.

As a fire is initiated on a portion of the flame-propagation auxiliary wick 9c by a heater or the like, the flame is propagated rapidly over the entire circumference of the auxiliary wick 9c. At the same time, this flame promotes the evaporation of the fuel from the fuel evaporating portion 9a of the main wick 9b to permit a smooth transition to the stable burning in the burning space 5. As explained before in connection with FIG. 2, the lower end of the auxiliary wick 9c in this state is spaced from the liquid fuel surface. In addition, since the auxiliary wick 9c is isolated from the main wick 9b by the fuel impermeable member 9d, no additional supply of the liquid fuel is made to the auxiliary wick 9c. Therefore, as the fuel initially contained by the auxiliary wick 9c is consumed away, a state so-called dry burning is created on the auxiliary wick 9c.

If the total area of the air pores 3a formed in the region of the outer flame sleeve 3 opposing to the auxiliary wick 9c is selected as large as that in the other region of the sleeve 3, there will be a vigorous formation of flame in this region to cause a rapid increase of the burning rate in the burning space 5. In this state, however, the upper part of the burning space 5, i.e. the upper portions of the inner and outer flame sleeves 2, 2, is still maintained at a low temperature, to act to suppress the promotion of burning. In consequence, the rate of generation of carbon monoxide, together with offensive odor, is increased inconveniently. In order to avoid this problem, in the desired embodiment, the number and size of the pores 3a formed in the region near the auxiliary wick 9c are selected to be smaller than those of the pores 3a formed in the remainder region on the outer flame sleeve 3a, so as to restrain the rate of discharge of the air. In consequence, the evaporation of the fuel is promoted only slowly and the rate of evaporation of fuel from the main wick 9b is increased correspondingly to the decrease of the liquid fuel contained by the auxiliary wick 9c. In consequence, the state of burning is progressively changed into stable burning in a smooth manner while achieving an almost perfect burning in the transient period.

Figure 8A:
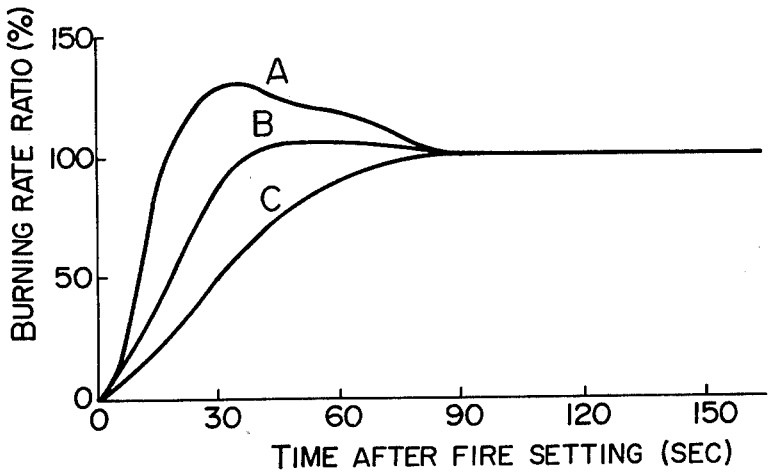
Figure 8B:
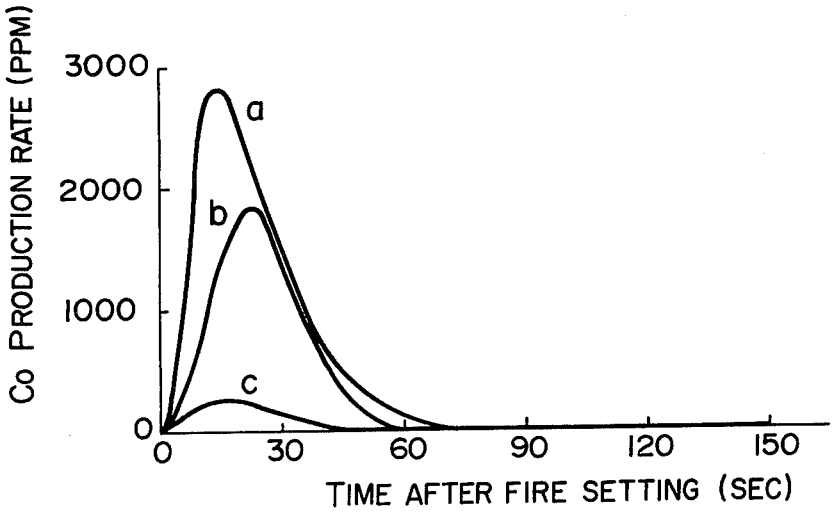

A curve A in FIG. 8 shows the change of the burning rate as observed in a test conducted with a kerosene stove, when the ratio of air discharge rate between the inner and outer flames sleeves 2 and 3, i.e. the ratio of area of pores between these sleeves in the region near the auxiliary wick 9*b*, is selected to be 1:1. In this case, a high rate of generation of carbon monoxide was observed as will be seen from a curve (a). Curves B, (b) and C (c) show the characteristics as observed when the above-mentioned ratio was selected to be 2:1 and 3:1, respectively. As will be realized from the curves C and (c), no excessive burning immediately after the start up was observed and the generation of carbon monoxide is remarkably reduced when the above-mentioned ratio is selected to be 3:1.

During the steady burning of the liquid fuel in the burning device, the auxiliary wick 9*c* is kept in the state of dry burning so that no substantial deposition of tar was found on the auxiliary wick 9*c*. This favorable effect is maintained for a long period of time, because the liquid fuel is sucked up and supplied to the auxiliary wick at each time the lower end of the auxiliary wick 9*c* is immersed in the liquid fuel when the wick 9 as a whole is lowered for extinction.

In the steady state of burning, the fuel is evaporated from the surface of fuel evaporating portion 9*c* of the main wick 9*b*. Since this surface is maintained at a high temperature and allowed to be contacted by oxygen, there is a possibility of generation and deposition of tar. The deposition of the tar is serious particularly when a part of the liquid fuel is deteriorated due to oxidation or change of quality, or when a component having a high boiling point is added to the fuel, as in the case of mixing of salad oil, light oil, machine oil and so forth in white kerosene. In such cases, there is a heavy deposition of tar to cause a clogging of the surface of the fuel evaporating portion 9*a* of the main wick 9*b* or the internal capillary tubes, in a comparatively short period of time. In consequence, the evaporation of the liquid fuel is restrained to cause an imperfect burning to permit the release of carbon monoxide, carbon and the offensive odor. In the described embodiment of the invention, the area of the air pores 2*a*' in the region of the inner flame sleeve 2 facing the fuel evaporating portion 9*a* of the main wick 9*b* is increased to permit the supply of air at a large rate, thereby to maintain a sufficiently large rate of fuel evaporation while lowering the temperature of the main wick 9*b*, so that the deposition of tar is effectively suppressed.

Figure 9A:
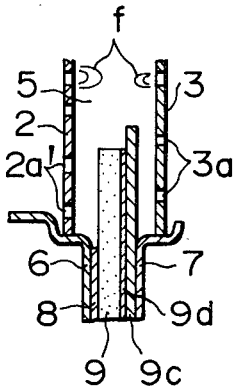
Figure 9B:
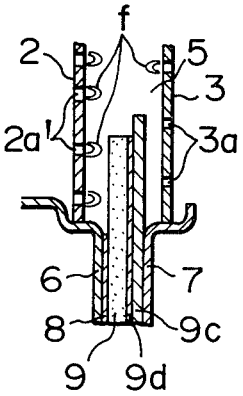

In the event that the fuel evaporation rate is decreased due to the accumulation of the tar, the mixture of air-fuel ratio suitable for catching fire is easily formed in the region around the fuel evaporating portion 9*a* of the main wick 9*b*, because air is supplied at a high rate to this region. Therefore, the state of burning is changed from that shown in FIG. 9A to the state shown in FIG. 9B as steady burning is commenced. As a result, the fuel evaporating portion 9*a* of the main wick 9*b* is allowed to receive air at a sufficiently large rate to promote the evaporation of the liquid fuel to recover the necessary burning rate and, at the same time, the tar deposition is thermally decomposed and removed by the pore flames "f" opposing to the fuel evaporating portion, so that a stable burning is maintained and the generation of offensive odor and carbon monoxide is suppressed effectively for a long period of use. It is to be noted that, by increasing the diameter of pores 2*a*' in the rows 2*a* of pores in the area close to the fuel evaporating portion 9*a* of the main wick 9*b*, the tendency of the formation of the pore wick "f" is increased and the removal of the tar deposition is accelerated. For further enhancing these effects, it is effective also to increase the number and size of the air pores 3*a* of the outer flame sleeve 3.

It is also to be noted that the increase of the number and size of the air pores 2*a*' of the air pore rows 2*a* opposing to the main wick 9*b* is quite effective from the view point of cleaning of the main wick. Namely, due to the increased number and size of the pores 2*a*', it is possible to obtain strong pore flames "f" to effectively increase the temperature of the fuel evaporating portion 9*a* of the main wick 9*b*, thereby to enhance the effect of dry burning which is intentionally conducted by continuing the burning while stopping the fuel supply so as to burn the tar deposition to clean the wick.

In the described embodiment, the fuel evaporating portion 9*a* of the main wick 9*b* is disposed at the inner side of the auxiliary wick 9*c*, and the opening area of the pores 9*a*' in the pore rows 2*a* of the inner flame sleeve 2 is selected to be greater than that of the pores 3*a* formed in the outer flame sleeve. Obviously, this positional and size relationships may be reversed without causing any substantial difference in effect.

As will be understood from the foregoing description, according to the invention, it is possible to eliminate the reduction of burning rate due to deposition of tar and to obviate various problems due to the imperfect burning attributable to the reduction in the burning rate, e.g. generation of noxious carbon monoxide and offensive odor. In addition, the undesirable increase of volume of the fuel evaporating portion, as well as the sticking of the wick to the metallic portions such as wick guide sleeve or wick outer sleeve, is effectively avoided to ensure a smooth driving of the wick up and down. These advantageous effects are obtainable without any deterioration of burning characteristics in the transient period between the start up of the burning device to the steady burning; similarly the start up characteristics are never affected. It is also to be noted that the stable burning is maintained regardless of any external disturbance factors such as wind, temperature change, mechanical impact and so forth.

In consequence, the liquid fuel burning device of the invention can maintain good and stable burning characteristics over a long period of time.

What is claimed is:

1. A liquid fuel burning device including an inner flame sleeve having a plurality of air pores in its wall, an outer flame sleeve surrounding said inner flame sleeve at a distance from the latter to form therebetween an annular burning space, said outer flame sleeve also having a plurality of air pores formed in the wall thereof, and a wick having a fuel evaporating portion projected into the burning space, characterized by comprising at least one vertical row of air pores formed in the wall of at least one of said inner flame sleeve and said outer flame sleeve facing said fuel evaporating portion and an auxiliary wick for propagating the starting flame, said auxiliary wick being disposed at the side of said fuel evaporating portion adjacent said inner flame sleeve or said outer flame sleeve with a fuel impermeable member interposed between the auxiliary wick and said fuel evaporating portion, said vertical row of air pores being formed in the wall of said flame sleeve which is on the opposite side of said fuel evaporating portion from said auxiliary wick;

a plurality of air pores formed in the wall facing said auxiliary wick and having a diameter smaller than that of the air pores formed in said wall facing said fuel evaporating portion wherein the total opening area of air pores formed in a predetermined area of the wall facing said auxiliary wick is selected to be smaller than that of air pores formed in a predetermined area of the wall facing said fuel evaporating portion.

2. A liquid fuel burning device as claimed in claim 1, characterized by further comprising a horizontal row of air pores formed in the region directly above said vertical row of air pores, said air pores of said horizontal row being arranged at a higher density than the pores formed in other regions of said wall.

3. A liquid fuel burning device as claimed in claim 2, wherein said vertical row of air pores is formed in the region of the wall of said inner flame sleeve facing said fuel evaporating portion, and wherein a partition plate having at least one aperture is attached to the inside of said inner flame sleeve at a level above said horizontal row of air pores, the total area of aperture or apertures of said partition plate being less than 20% of the horizontal cross-sectional area of said inner flame sleeve as measured at the inner side of the latter.

4. The device of claim 2 in which said horizontal row of air pores is just above the top edge of the wick projecting into the burning space.

5. The device of claim 1 in which said at least one vertical row of air pores is circumferentially spaced around the inner flame sleeve and directly above said at least one vertical row is at least one circumferentially extending horizontal row of air pores, said at least one horizontal row having at least twice the circumferential density of air pores as that of said at least one vertical row.

6. The device of claim 5 including a partition plate across said inner flame sleeve immediately above said at least one horizontal row; said partition plate having a plurality of apertures, the total aperture area being less than 20% of the horizontal cross-sectional area of said inner flame sleeve.

* * * * *